US009428965B2

(12) United States Patent
Jones

(10) Patent No.: US 9,428,965 B2
(45) Date of Patent: Aug. 30, 2016

(54) SUBSURFACE DRILLING TOOL

(71) Applicant: Kevin Dewayne Jones, Clinton, OK (US)

(72) Inventor: Kevin Dewayne Jones, Clinton, OK (US)

( * ) Notice: Subject to any disclaimer, the term of this patent is extended or adjusted under 35 U.S.C. 154(b) by 0 days.

(21) Appl. No.: 14/290,597

(22) Filed: May 29, 2014

(65) Prior Publication Data

US 2015/0075868 A1 Mar. 19, 2015

Related U.S. Application Data

(60) Provisional application No. 61/879,131, filed on Sep. 17, 2013.

(51) Int. Cl.

| | |
|---|---|
| ***E21B 10/10*** | (2006.01) |
| ***E21B 10/52*** | (2006.01) |
| ***E21B 10/08*** | (2006.01) |
| ***E21B 10/16*** | (2006.01) |
| ***E21B 10/18*** | (2006.01) |
| ***E21B 10/22*** | (2006.01) |
| ***E21B 10/633*** | (2006.01) |

(52) U.S. Cl.

CPC ..... *E21B 10/52* (2013.01); *E21B 10/08* (2013.01); *E21B 10/10* (2013.01); *E21B 10/16* (2013.01); *E21B 10/18* (2013.01); *E21B 10/22* (2013.01); *E21B 10/633* (2013.01)

(58) Field of Classification Search

CPC .... E21B 10/10; E21B 10/003; E21B 10/083; E21B 10/086; E21B 10/08

USPC ..... 175/352, 367, 368, 369, 370, 361, 362, 175/363, 364, 353

See application file for complete search history.

(56) References Cited

U.S. PATENT DOCUMENTS

| | | | | | |
|---|---|---|---|---|---|
| 1,124,242 | A | * | 1/1915 | Hughes | 175/334 |
| 1,195,208 | A | * | 8/1916 | Griffin | 175/354 |
| 1,231,159 | A | * | 6/1917 | Hughes | 175/339 |
| 1,236,982 | A | * | 8/1917 | Reed | 175/350 |
| 1,238,407 | A | * | 8/1917 | Hughes | 175/350 |
| 2,133,022 | A | * | 10/1938 | Fisher | 175/340 |
| 3,860,292 | A | * | 1/1975 | Bechem | 299/110 |
| 4,256,191 | A | * | 3/1981 | Jones | 175/93 |
| 4,552,232 | A | * | 11/1985 | Frear | 175/337 |
| 4,610,317 | A | * | 9/1986 | England et al. | 175/331 |
| 2005/0133273 | A1 | * | 6/2005 | Chen et al. | 175/374 |

* cited by examiner

*Primary Examiner* — Robert E Fuller

(74) *Attorney, Agent, or Firm* — McKee, Voorhees & Sease, PLC

(57) ABSTRACT

An improved subsurface drilling tool comprises a shank having a cutting end opposite a pin end configured to attach to a drill string. A plurality of ear portions is associated with the proximate end of the shank and configured to form a socket. A ball-shaped cutting tool is configured to fit inside the socket and is rotatably attach to the ear portions via an axle. A locking pin may be installed within one or more of the ear portions and perpendicular to the axle. A plurality of blade inserts is connected to the ball-shaped cutting tool. The blade inserts may be removable and/or configurable to be oriented in varied directions. A series of milling courses may extend longitudinally along an outside length of the shank. A fluid course may extend longitudinally within the shank to deliver drilling fluid to the cutting end.

20 Claims, 3 Drawing Sheets

SUBSURFACE DRILLING TOOL

CROSS-REFERENCE TO RELATED APPLICATION

This application claims the benefit of U.S. Provisional Patent Application Ser. No. 61/879,131 filed Sep. 17, 2013, which is incorporated herein by reference in its entirety.

FIELD OF THE INVENTION

The present invention relates in general to subsurface drilling tools and cutting elements for drill bits or other tools incorporating the same. More specifically, embodiments disclosed herein relate generally to rotatable cutting elements for rotary drill bits for deep well drilling.

BACKGROUND OF THE INVENTION

Drill bits used to drill wellbores through earth formations generally are made within one of two broad categories of bit structures. Depending on the application/formation to be drilled, the appropriate type of drill bit may be selected based on the cutting action type for the bit and its appropriateness for use in the particular formation. Drill bits in the category generally known as "roller cone" bits, include a bit body having one or more roller cones rotatably mounted to the bit body. The bit body is typically formed from steel or another high strength material. The roller cones are also typically formed from steel or other high strength material and include a plurality of cutting elements disposed at selected positions about the cones. The cutting elements may be formed from the same base material as is the cone. These bits are typically referred to as "milled tooth" bits. Other roller cone bits include "insert" cutting elements that are press (interference) fit into holes formed and/or machined into the roller cones. The inserts may be formed from, for example, tungsten carbide, natural or synthetic diamond, boron nitride, or any one or combination of hard or superhard materials.

Drill bits of the category typically referred to as "fixed cutter" or "drag" bits, include bits that have cutting elements attached to the bit body. Drag bits may generally be defined as bits that have no moving parts. However, there are different types and methods of forming drag bits that are known in the art. For example, drag bits having abrasive material, such as diamond, impregnated into the surface of the material which forms the bit body are commonly referred to as "impreg" bits. Drag bits having cutting elements made of an ultra-hard cutting surface layer or "table" (typically made of polycrystalline diamond material or polycrystalline boron nitride material) deposited onto or otherwise bonded to a substrate are known in the art as polycrystalline diamond compact ("PDC") bits. PDC bits drill soft formations easily, but they are frequently used to drill moderately hard or abrasive formations. They cut rock formations with a shearing action using small cutters that do not penetrate deeply into the formation. Because the penetration depth is shallow, high rates of penetration are achieved through relatively high bit rotational velocities.

PDC cutters have been used in industrial applications including rock drilling and metal machining for many years. In PDC bits, PDC cutters are received within cutter pockets, which are formed within blades extending from a bit body, and are typically bonded to the blades by brazing to the inner surfaces of the cutter pockets. The PDC cutters are positioned along the leading edges of the bit body blades so that as the bit body is rotated, the PDC cutters engage and drill the earth formation. In use, high forces may be exerted on the PDC cutters, particularly in the forward-to-rear direction. Additionally, the bit and the PDC cutters may be subjected to substantial abrasive forces. In some instances, impact, vibration and erosive forces have caused drill bit failure due to loss of one or more cutters, or due to breakage of the blades.

In a typical PDC cutter, a compact of polycrystalline diamond ("PCD") (or other superhard material, such as polycrystalline cubic boron nitride) is bonded to a substrate material, which is typically a sintered metal-carbide to form a cutting structure. PCD comprises a polycrystalline mass of diamond grains or crystals that are bonded together to form an integral, tough, high-strength mass or lattice. The resulting PCD structure produces enhanced properties of wear resistance and hardness, making PCD materials extremely useful in aggressive wear and cutting applications where high levels of wear resistance and hardness are desired.

A significant factor in determining the longevity of PDC cutters is the exposure of the cutter to heat. Conventional polycrystalline diamond is stable at temperatures of up to 700-750° Celsius in air, above which observed increases in temperature may result in permanent damage to and structural failure of polycrystalline diamond. This deterioration in polycrystalline diamond is due to the significant difference in the coefficient of thermal expansion of the binder material, cobalt, as compared to diamond. Upon heating of polycrystalline diamond, the cobalt and the diamond lattice will expand at different rates, which may cause cracks to form in the diamond lattice structure and result in deterioration of the polycrystalline diamond. Damage may also be due to graphite formation at diamond-diamond necks leading to loss of microstructural integrity and strength loss, at extremely high temperatures.

Exposure to heat (through brazing or through frictional heat generated from the contact of the cutter with the formation) can cause thermal damage to the diamond table and eventually result in the formation of cracks (due to differences in thermal expansion coefficients) which can lead to spalling of the polycrystalline diamond layer, delamination between the polycrystalline diamond and substrate, and conversion of the diamond back into graphite causing rapid abrasive wear. As a cutting element contacts the formation, a wear flat develops and frictional heat is induced. As the cutting element is continued to be used, the wear flat will increase in size and further induce frictional heat. The heat may build-up that may cause failure of the cutting element due to thermal miss-match between diamond and catalyst discussed above. This is particularly true for cutters that are immovably attached to the drill bit, as conventional in the art.

Accordingly, there exists a continuing need to develop ways to extend the life of a cutting element and improve the drilling process.

BRIEF SUMMARY OF THE INVENTION

Therefore, it is a principal object, feature, and/or advantage of the present invention to overcome the aforementioned deficiencies in the art and provide a new and improved subsurface drilling tool that will efficiently drill hard rock formations.

Another object, feature, and/or advantage of the present invention is to provide a subsurface drilling bit with new and improved alternating rotating cones having hard inserts embedded therein and protruding therefrom to crush hard rock formation.

A further object, feature, and/or advantage of the present invention is to provide a subsurface drilling bit that eliminates or minimizes sticky clay or shale drill cuttings from preferentially adhering to and "balling-up" a drill bit cutting face while drilling in a bore hole.

Another object, feature, and/or advantage of the present invention is to provide a subsurface drilling bit that has replaceable hard inserts embedded therein for easy access and increased efficiency.

These and/or other objects, features, and/or advantages of the present invention will be apparent to those skilled in the art. The present invention is not to be limited to or by these objects, features, and advantages. No single aspect need provide each and every object, feature, or advantage.

According to one aspect of the present invention, a subsurface drilling tool, particularly a drill bit, is provided. The drill bit includes a bit body or shank, wherein the shank comprises a pin end and an opposite cutting end. The pin end is open and comprises a fluid course extending longitudinally from the open pin end, through the shank, and through the cutting end for drilling fluid to transfer through the shank. The pin end includes a pin, screw, threads, or other means standard in the industry for attaching a drill bit to a drill stem. The cutting end comprises a plurality of ear portions configured to form the shape of a socket, wherein a ball shaped cutting tool fits inside the socket and is rotatably attached to the plurality of ear portions via an axle. The ball shaped cutting tool comprises a plurality of cones, preferably two, shaped like half-domes and placed adjacent to one another to form the ball shape. The plurality of cones further comprise weights configured to cause the plurality of cones to rotate in opposite directions around the axle while the drill bit is drilling or cutting through the ground, rock, or other material. The drilling or cutting is caused by a plurality of blade inserts, preferably metal-carbide, that fit inside and protrude therefrom a plurality of holes covering the exterior of the ball shaped cutting tool, wherein each blade insert comprises a cutting face and a trailing face. The plurality of cones and, consequently, the ball shaped cutting tool may be locked in place via a locking pin through the axle. The drill bit of the present invention further includes a series of milling courses extending longitudinally along the outside length of the shank for milling and particles of formation to flow to the surface through the bore hole.

According to another aspect of the present invention, a method of subsurface drilling using a drill bit includes providing a drill and a drill bit. The drill bit includes a bit body or shank, wherein the shank comprises a pin end and an opposite cutting end. The pin end is open and comprises a fluid course extending longitudinally from the open pin end, through the shank, and through the cutting end for drilling fluid to transfer through the shank. The pin end includes a pin, screw, threads, or other means standard in the industry for attaching a drill bit to a drill. The cutting end comprises a plurality of ear portions configured to form the shape of a socket, wherein a ball shaped cutting tool fits inside the socket and is rotatably attached to the plurality of ear portions via an axle. The ball shaped cutting tool comprises a plurality of cones, preferably two, shaped like half-domes and placed adjacent to one another to form the ball shape. The plurality of cones further comprise weights configured to cause the plurality of cones to rotate in opposite directions around the axle while the drill bit is drilling or cutting through the ground, rock, or other material. The drilling or cutting is caused by a plurality of blade inserts, preferably metal-carbide, that fit inside and protrude therefrom a plurality of holes covering the exterior of the ball shaped cutting tool, wherein each blade insert comprises a cutting face and a trailing face. The plurality of cones and, consequently, the ball shaped cutting tool may be locked in place via a locking pin through the axle. The drill bit of the present invention further includes a series of milling courses extending longitudinally along the outside length of the shank for milling and particles of formation to flow to the surface through the bore hole. The method subsequently involves attaching the drill bit to the drill, inserting the drill bit into the ground, and starting to drill.

Different aspects may meet different objects of the invention. Other objectives and advantages of this invention will be more apparent in the following detailed description taken in conjunction with the figures. The present invention is not to be limited by or to these objects or aspects.

DESCRIPTION OF FIGURES

FIG. 1 is a perspective view of a subsurface drilling tool in accordance with an illustrative embodiment of the present invention.

FIG. 2 is a cross sectional view of the subsurface drilling tool of FIG. 1 taken along section lines 2-2.

FIG. 3 is a bottom view of the subsurface drilling tool of FIG. 1.

DETAILED DESCRIPTION OF THE INVENTION

Figure 1:
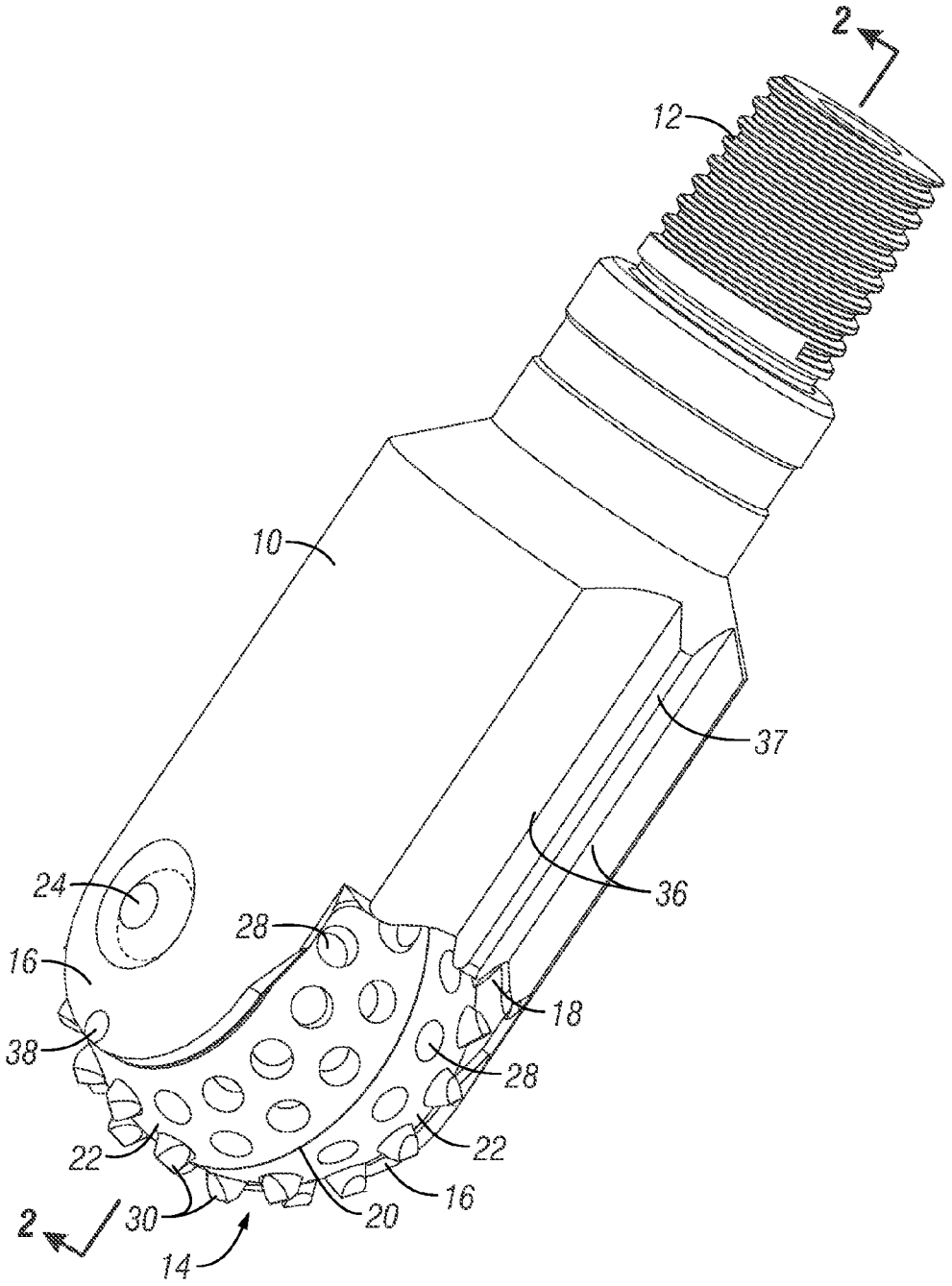
FIGS. 1-3 represent examples of subsurface drilling tools of the present invention, and a method of subsurface drilling utilizing the present invention.

FIG. 1 illustrates a subsurface drilling tool, particularly a drill bit, in accordance with an exemplary embodiment of the present invention. A rolling cutter, such as the one herein described, is a cutting element having at least one surface that may rotate within a cutter pocket as the cutting element contacts the drilling formation. As the cutting element contacts the formation, shearing may allow a portion of the cutting element to rotate around a cutting element axis extending through a central plane of the cutting element. The drill bit of the present invention includes a bit body or shank (10), wherein the shank (10) comprises a pin end (12) and an opposite cutting end (14). The shank (10) may be formed of material including, for example, metal, carbides, such as tungsten carbide, tantalum carbide, or titanium carbide, nitrides, ceramics and diamond, such as polycrystalline diamond, or a combination thereof. Also illustrated in FIG. 1, the pin end (12) has the usual threaded portion by which it may be connected to a typical drill stem (not shown), although other means standard in the industry such as pins, screws, or other means for attaching a drill bit to a drill stem may be utilized. The construction of the shank (10) may be of a conventional type well known and heretofore extensively used in rolling cutters in a conventional cross roller cutter bit.

The cutting end (14) comprises a plurality of ear portions (16), preferably two, located opposite one another on both sides of the shank (10). Moreover, the ear portions (16) extend beyond the shank (10) to assist in forming the cutting end (14) of the shank (10). For instance, the ear portions (16) are configured to form the shape of a socket (18), wherein a ball shaped cutting tool (20) fits inside the socket (18) and is rotatably attached to the plurality of ear portions (16) via an axle (24). Comprising the ball shaped cutting tool (20) is a plurality of cones (22), preferably two, shaped like half-domes and located adjacent to one another to form the ball shape as illustrated in FIG. 1. The ball shaped cutting tool (20) is thus snugly engaged and held in place by the socket (18). The drill bit of the present invention further includes a locking pin (38) to lock the axle (24) in place, thus, effectively locking the plurality of cones (22) into a set position.

Figure 2:
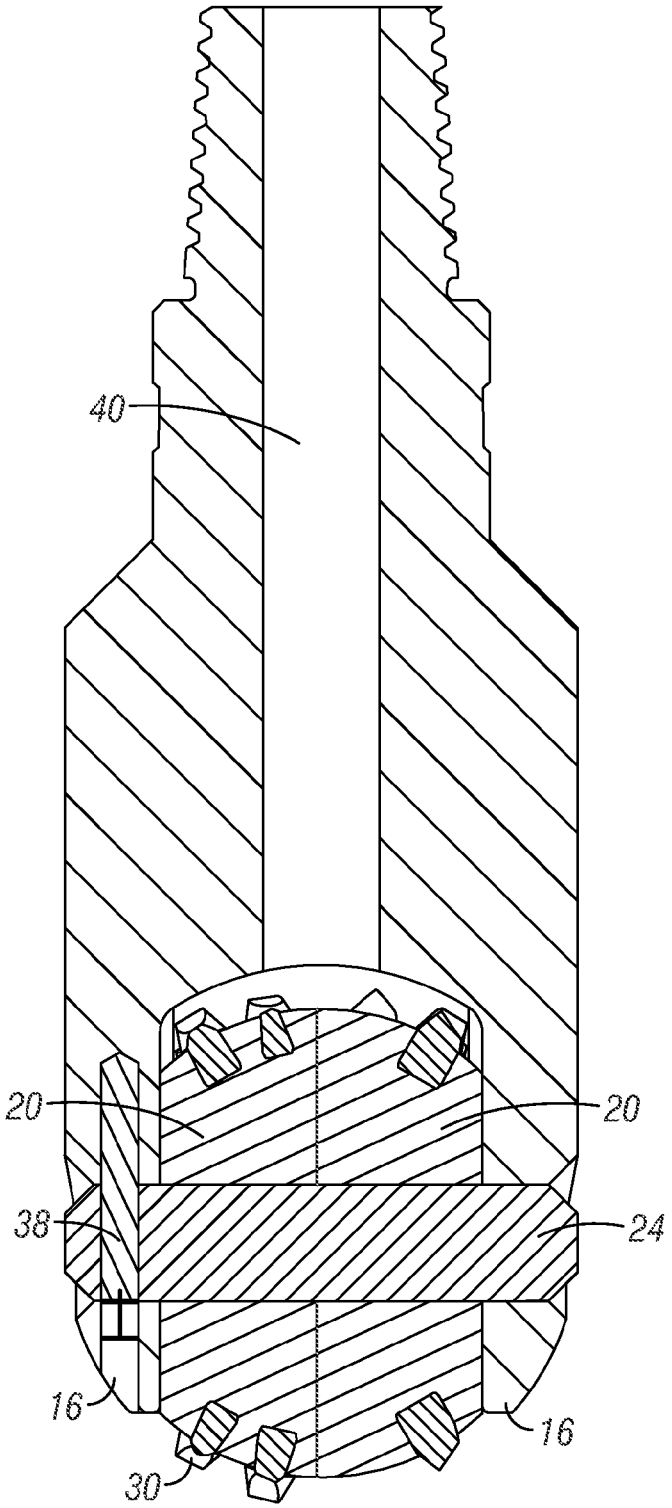

As further illustrated in FIGS. 1 and 2, when the drill bit is rotated by the drill stem (not shown) in a bore hole, the plurality of cones (22) rotate on the axle (24) and, as a very great pressure is applied by the weight of the drill stem, the plurality of cones (22) will crush the hard formation on which the drill bit is rotated. The pin end (12) of the present invention is open and comprises a fluid course (40) extending longitudinally from the open pin end (12), through the shank (10), and through the cutting end (14) for drilling fluid to transfer through the shank (10). The milling or particles of formation crushed by the plurality of cones (22) will be removed by the drilling fluid which is pumped in the usual manner through the open pin end (12), down through the fluid course (40) and continuing through and around the cutting end (14). The milling or particles of formation will subsequently return to the surface of the earth through the series of milling courses (36) and walls of the bore hole. Thus, this process eliminates or significantly reduces "bit-balling" at this critical area of the drill bit's cutting end (14).

The arrangement of the plurality of cones (22) is such that the cones will crush substantially the entire area of the bottom of the bore hole. Moreover, the plurality of cones (22) is of such composition and so manufactured as to have an extremely high compressive strength, and to be extremely resistant to transverse rupture and to abrasion. For example the plurality of cones (22) may be made of a composition of tungsten, cobalt, iron and carbon processed to produce the desired properties just referred to. The plurality of cones (22) forming the ball shaped cutting tool (20) will take the extreme loads required in drilling hard rock. No bending moment is imposed upon the hard metal of which the plurality of cones (22) is made. The plurality of cones (22) will take loads imposed upon them from any direction under operating conditions. The plurality of cones (22) forming the ball shaped cutting tool (20) eliminates sharp corners in the shank (10) from which cracks might start, thus, effectively increasing the life of the drill bit. Also, it has been found that the use of the plurality of cones (22) in forming the ball shaped cutting tool (20) not only simplifies and reduces the cost of manufacture, but also facilitates final assembly and repair of the drill bit of the present invention.

Figure 3:
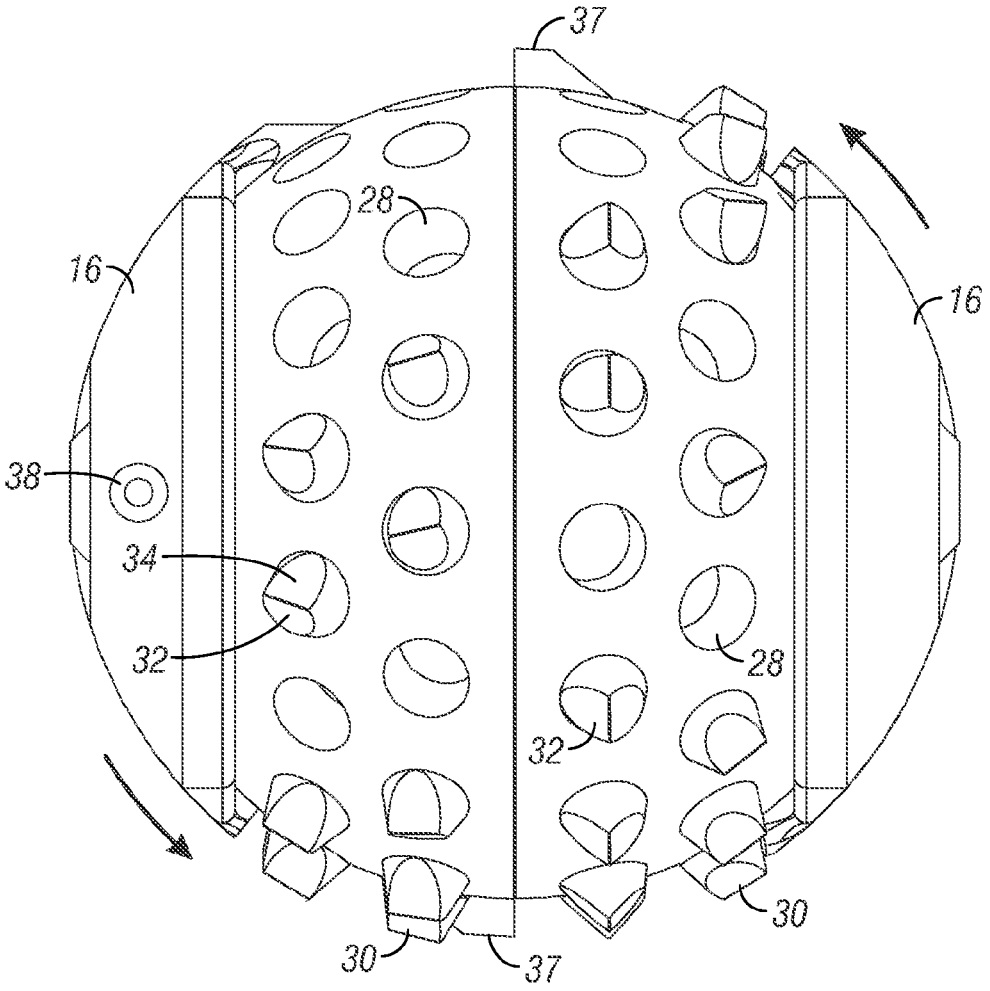

Illustrated in FIGS. 1 and 3, the drilling or cutting is accomplished by a plurality of blade inserts (30) that fit inside a plurality of holes (28) covering the exterior of the ball shaped cutting tool (20). One blade insert of the plurality of blade inserts (30) is snugly fitted into one hole of the plurality of holes (28) and attached by means known in the industry, such as via brazing, interference fitting, welding, or threaded screws, so that the blade insert (30) does not rotate within the hole (28). Alternatively, in other embodiments, blade inserts (30) may rotate within their respective holes (28). The plurality of blade inserts (30) may have a cutting face (32) and a trailing face (34), wherein the cutting face (32) faces in the direction of blade rotation.

The plurality of blade inserts (30) according to embodiments of the present disclosure may be formed of material including, for example, metal, carbides, such as tungsten carbide, tantalum carbide, or titanium carbide, nitrides, ceramics and diamond, such as polycrystalline diamond, or a combination of substrates thereof. For instance, a carbide substrate utilized in the present invention may include metal carbide grains, such as tungsten carbide, supported by a matrix of a metal binder. Various binding metals may be present in the substrate, such as cobalt, nickel, iron, alloys thereof, or mixtures, thereof. In a particular embodiment, the substrate may be formed of a sintered tungsten carbide composite structure of tungsten carbide and cobalt. However, it is known that various metal carbide compositions and binders may be used in addition to tungsten carbide and cobalt. Thus, references to the use of tungsten carbide and cobalt are for illustrative purposes only, and no limitation on the type of carbide or binder use is intended. Further, diamond composites, such as diamond/silicon or diamond/carbide composites, may be used to form the plurality of blade inserts (30).

According to a further aspect of the present invention a method of subsurface drilling using a drilling tool, particularly a drill bit, is provided. Illustrated in FIGS. 1-3, the method includes providing a drill and the aforementioned drill bit. For instance, the drill bit includes a bit body or shank (10), wherein the shank (10) comprises a pin end (12) and an opposite cutting end (14). The pin end (12) is open and comprises a fluid course (40) extending longitudinally from the open pin end (12), through the shank (10), and through the cutting end (14) for drilling fluid to transfer through the shank (10). The pin end (12) includes means standard in the industry for attaching the drill bit to a drill stem. The cutting end (14) comprises a plurality of ear portions (16) configured to form the shape of a socket (18), wherein a ball shaped cutting tool (20) fits inside the socket (18) and is rotatably attached to the plurality of ear portions (16) via an axle (24). The ball shaped cutting tool (20) comprises a plurality of cones (22), preferably two, shaped like half-domes and placed adjacent to one another to form the ball shape. The plurality of cones (22) further comprise weights (26) configured to cause the plurality of cones (22) to rotate in opposite directions around the axle (24) while the drill bit is drilling or cutting through the ground, rock, or other material. The drilling or cutting is caused by a plurality of blade inserts (30), preferably metal-carbide, that fit inside and protrude therefrom a plurality of holes (28) covering the exterior of the ball shaped cutting tool (20), wherein each blade insert (30) comprises a cutting face (32) and a trailing face (34). The plurality of cones (22) and, consequently, the ball shaped cutting tool (20) may be locked in place via a locking pin (38) through the axle (24). The drill bit further includes a series of milling courses (36) extending longitudinally along the outside length of the shank (10). As illustrated in FIGS. 1 and 3, the milling courses (36) can be associated a ridge (37) extending outwardly and disposed on opposite sides of the shank (10). The milling courses (36) and the ridges (37) may comprise planar surfaces. As illustrated in FIG. 3, a planar surface of a ridge (37) may substantially align with a plane separating the plurality of cones (22). The method subsequently involves attaching the drill bit to the drill, inserting the drill bit into the ground, and starting to drill.

The subsurface drilling tool of the present invention and method of drilling using the subsurface drilling tool are universally applicable to drilling apparatuses of all shapes and sizes, makes, models, and manufacturers. Furthermore, while intended for large subsurface drilling operations, the drilling tool of the present invention may be used for drilling in all manner of uses, large and small. Although the invention has been described and illustrated with respect to preferred aspects thereof, it is not to be so limited since changes and modifications may be made therein which are within the full intended scope of the invention.

What is claimed is:

1. A drill bit, comprising:

a shank, wherein the shank comprises a cutting end and an opposite pin end configured to be attached to a drill string;

a plurality of ear portions disposed proximate to the cutting end of the shank and configured to form a socket, at least one of the plurality of ear portions having a locking pin hole configured to receive a locking pin;

a ball-shaped cutting tool comprising a plurality of cones partially recessed within the socket;

milling courses separated by ridges extending outwardly from the shank, wherein the ridges have a planar surface substantially aligned with a plane separating the plurality of cones;

wherein the ball-shaped cutting tool is rotatably attached to the plurality of ear portions via an axle;

wherein the locking pin is perpendicular to the axle; and wherein the plurality of cones rotates in opposite directions around the axle while the drill bit is drilling.

2. The drill bit of claim 1, wherein a single one of the plurality of ear portions has the locking pin hole configured to receive the locking pin.

3. The drill bit of claim 1, further comprising a plurality of holes covering an exterior of the ball-shaped cutting tool.

4. The drill bit of claim 3, further comprising a plurality of blade inserts that fit inside the plurality of holes, wherein each blade insert comprises a cutting face and a trailing face separated by a blade edge, wherein the blade edges are configured to be oriented in varied directions.

5. The drill bit of claim 4, wherein the plurality of blade inserts are metal-carbide.

6. The drill bit of claim 1, wherein the ridges are disposed on opposite sides of the shank.

7. A drill bit, comprising:

a shank, wherein the shank comprises a cutting end opposite a pin end configured for attachment to a drill string;

a plurality of ear portions associated with the cutting end of the shank and configured to form a socket;

a ball-shaped cutting tool a plurality of cones partially recessed within the socket;

a plurality of blade inserts removably connected to each of the plurality of cones, wherein each of the plurality of blade inserts comprises a cutting face and a trailing face;

milling courses separated by ridges extending outwardly from the shank, wherein the ridges have a planar surface substantially aligned with a plane separating the plurality of cones;

wherein the ball-shaped cutting tool is rotatably attached to the plurality of ear portions via an axle; and wherein the blade edges are configured to be selectively oriented in varied directions.

8. The drill bit of claim 7, further comprising a plurality of holes covering an exterior of the ball-shaped cutting tool.

9. The drill bit of claim 8, wherein the ridges are disposed on opposite sides of the shank.

10. The drill bit of claim 8, further comprising a locking pin perpendicular to the axle to lock the plurality of concave cones in a set position.

11. The drill bit of claim 10, further comprising a fluid course extending longitudinally from the open pin end, through the shank, to the cutting end for drilling fluid to transfer through the shank.

12. The drill hit of claim 7 wherein the plurality of blade inserts are configured to rotate within each of the plurality of concave cones of the ball-shaped cutting tool.

13. The drill bit of claim 12, wherein the plurality of blade inserts are meta carbide.

14. A method of subsurface drilling, comprising:

providing a drill bit comprising:

a) a shank having a cutting end, a pin end opposite the cutting end and configured to attach to a drill string, and a fluid course extending from the pin end through an interior of the shank;

b) a plurality of ear portions disposed proximate to the cutting end of the shank, and configured to form a socket;

c) a ball-shaped cutting tool comprising a plurality of cones configured to be partially recessed inside the socket, and rotatably attached to the plurality of ear portions via an axle; and d) milling courses separated by a ridge extending longitudinally along an outside length of opposite surfaces of the shank disposed between the plurality of ear portions, wherein the milling courses and the ridge comprise planar surfaces;

attaching the drill bit to the drill string;

inserting the drill bit into the material to be drilled;

starting to drill; and removing material from drilling through the milling courses.

15. The method of claim 14, further comprising the steps of:

inserting a plurality of removable blade inserts into the ball-shaped cutting tool, wherein each of the plurality of removable blade inserts is associated with one of a plurality of holes covering an exterior of the ball-shaped cutting tool; and orienting the removable blade inserts in a plurality of directions.

16. The method of claim 15, further comprising the step of:

providing fluid from a fluid source through the fluid course to the plurality of removable blade inserts.

17. The method of claim 16, further comprising the step of:

inserting a locking pin into one of the plurality of ear portions and the axle to lock the plurality of cones.

18. The method of claim 14 wherein the planar surface of the ridge is substantially aligned with a plane separating the plurality of cones.

19. A drill bit, comprising:

a shank, wherein the shank comprises a cuffing end and an opposite pin end configured to be attached to a drill string;

a plurality of ear portions disposed proximate to the cutting end of the shank and configured to form a socket, at least one of the plurality of ear portions having a locking pin hole configured to receive a locking pin;

a ball-shaped cutting tool comprising a plurality of cones;

a series of milling courses extending longitudinally along the outside length of the shank, wherein the series of milling courses are separated by ridges extending outwardly from opposite sides of the shank, wherein the milling courses and the ridges comprise planar surfaces;

wherein the ball-shaped cutting tool is configured to fit inside the socket and is rotatably attached to the plurality of ear portions via an axle;

wherein the locking pin is perpendicular to the axle; and wherein the plurality of cones rotates in opposite directions around the axle while the drill bit is drilling.

20. The drill bit of claim 19, further comprising a fluid course extending longitudinally from the pin end through the shank to deliver drilling fluid to a portion of the plurality of cones proximate to the pin end.

* * * * *